US007610773B2

(12) United States Patent
Rafalovich et al.

(10) Patent No.: US 7,610,773 B2
(45) Date of Patent: Nov. 3, 2009

(54) ICE PRODUCING APPARATUS AND METHOD

(75) Inventors: Alexander Pinkus Rafalovich, Louisville, KY (US); Sanjay Manohar Anikhindi, Bangalore (IN)

(73) Assignee: General Electric Company, Schenectady, NY (US)

( * ) Notice: Subject to any disclaimer, the term of this patent is extended or adjusted under 35 U.S.C. 154(b) by 391 days.

(21) Appl. No.: 11/610,798

(22) Filed: Dec. 14, 2006

(65) Prior Publication Data

US 2008/0141699 A1 Jun. 19, 2008

(51) Int. Cl.
*F25C 1/12* (2006.01)

(52) U.S. Cl. ..... 62/356; 62/434

(58) Field of Classification Search ..... 62/66–74, 62/340–356, 434–435
See application file for complete search history.

(56) References Cited

U.S. PATENT DOCUMENTS 1,962,580 A * 6/1934 Carpenter ..... 62/534
2,287,255 A * 6/1942 Langgaard ..... 62/346
2,514,301 A * 7/1950 Tenney ..... 62/120
2,942,432 A * 6/1960 Muffly ..... 62/155
3,788,089 A * 1/1974 Graves ..... 62/137
4,344,298 A 8/1982 Biemiller
4,942,742 A 7/1990 Burruel
6,148,634 A * 11/2000 Sherwood ..... 62/434
6,588,219 B2 7/2003 Zevlakis

* cited by examiner

*Primary Examiner*—William E Tapolcai
(74) *Attorney, Agent, or Firm*—Global Patent Operation; Douglas D. Zhang

(57) ABSTRACT

An ice producing apparatus for a refrigerator includes a storage tank configured to store a cooling medium. A first heat exchanger is disposed downstream of the storage tank and is configured to have the cooling medium flow therethrough to be cooled. An ice mold includes at least one cavity that is configured to retain water therein. A second heat exchanger is disposed downstream of the first heat exchanger and is configured to have the cooling medium flow therethrough to freeze the water in the ice mold to produce ice.

8 Claims, 2 Drawing Sheets

ICE PRODUCING APPARATUS AND METHOD

BACKGROUND OF THE INVENTION

The described technology relates to an ice producing apparatus, such as for a refrigerator, and more particularly such as for a refrigerator including a bottom freezer compartment disposed below a top fresh food compartment, and a corresponding method.

In a known refrigerator, an ice maker delivers ice through an opening in a door of a refrigerator. Such a known refrigerator has a freezer section to the side of a fresh food section. This type of refrigerator is often referred to as a "side-by-side" refrigerator.

In the side-by-side refrigerator, the ice maker delivers ice through the door of the freezer section. In this arrangement, ice is formed by freezing water with cold air in the freezer section, the air being made cold by a cooling system including an evaporator.

Another known refrigerator includes a bottom freezer section disposed below a top fresh food section. This type of refrigerator is often referred to as a "bottom freezer" or "bottom mount freezer" refrigerator. In this arrangement, convenience necessitates that the ice maker deliver ice through the opening in the door of the fresh food section, rather than the freezer section. However, the cool air in the fresh food section is generally not cold enough to freeze water to form ice.

In the bottom freezer refrigerator, it is known to pump cold air, which is cooled by the evaporator of the cooling system, within an interior of the door of the fresh food section to the ice maker. This arrangement suffers from numerous disadvantages, however. For example, complicated air ducts are required, within the interior of the door, for the cold air to flow to the ice maker. Further, ice is made at a relatively slow rate, due to limitations on a volume and/or temperature of cold air that can be pumped within the interior of the door of the fresh food section. Another disadvantage is that pumping the cold air from the freezer compartment, during ice production, reduces a temperature of the fresh food compartment below the set point.

BRIEF DESCRIPTION OF EMBODIMENTS OF THE INVENTION

As described herein, embodiments of the invention overcome one or more of the above or other disadvantages known in the art.

In an embodiment, an ice producing apparatus for a refrigerator includes a storage tank configured to store a cooling medium. A first heat exchanger is disposed downstream of the storage tank and is configured to have the cooling medium flow therethrough to be cooled. An ice mold includes at least one cavity that is configured to retain water therein. A second heat exchanger is disposed downstream of the first heat exchanger and is configured to have the cooling medium flow therethrough to freeze the water in the ice mold to produce ice.

In another embodiment, a refrigerator includes a compartment cooling section configured to cool an interior compartment of the refrigerator, the compartment cooling section including a first heat exchanger configured to have a refrigerant flow therethrough to absorb heat. An ice producing apparatus is configured to produce ice and to deliver the produced ice through an opening in a door of the refrigerator. The ice producing apparatus includes a storage tank configured to store a cooling medium. A second heat exchanger is disposed downstream of the storage tank and is configured to have the cooling medium flow therethrough to be cooled. An ice mold includes at least one cavity that is configured to retain water therein. A third heat exchanger is disposed downstream of the second heat exchanger and is configured to have the cooling medium flow therethrough to freeze the water in the ice mold to produce ice.

In yet another embodiment, method of producing ice in a refrigerator includes flowing a refrigerant through a cooling system to cool an interior compartment of the refrigerator, flowing a cooling medium different than the refrigerant through a first heat exchanger to decrease a temperature of the cooling medium, and flowing the cooling medium through a second heat exchanger to freeze water that is disposed in an ice mold adjacent the second heat exchanger.

BRIEF DESCRIPTION OF THE DRAWINGS

The following figures illustrate examples of embodiments of the invention. The figures are described in detail below.

DETAILED DESCRIPTION OF EMBODIMENTS OF THE INVENTION

Embodiments of the invention are described below, with reference to the figures. Throughout the figures, like reference numbers indicate the same or similar components.

Figure 1:
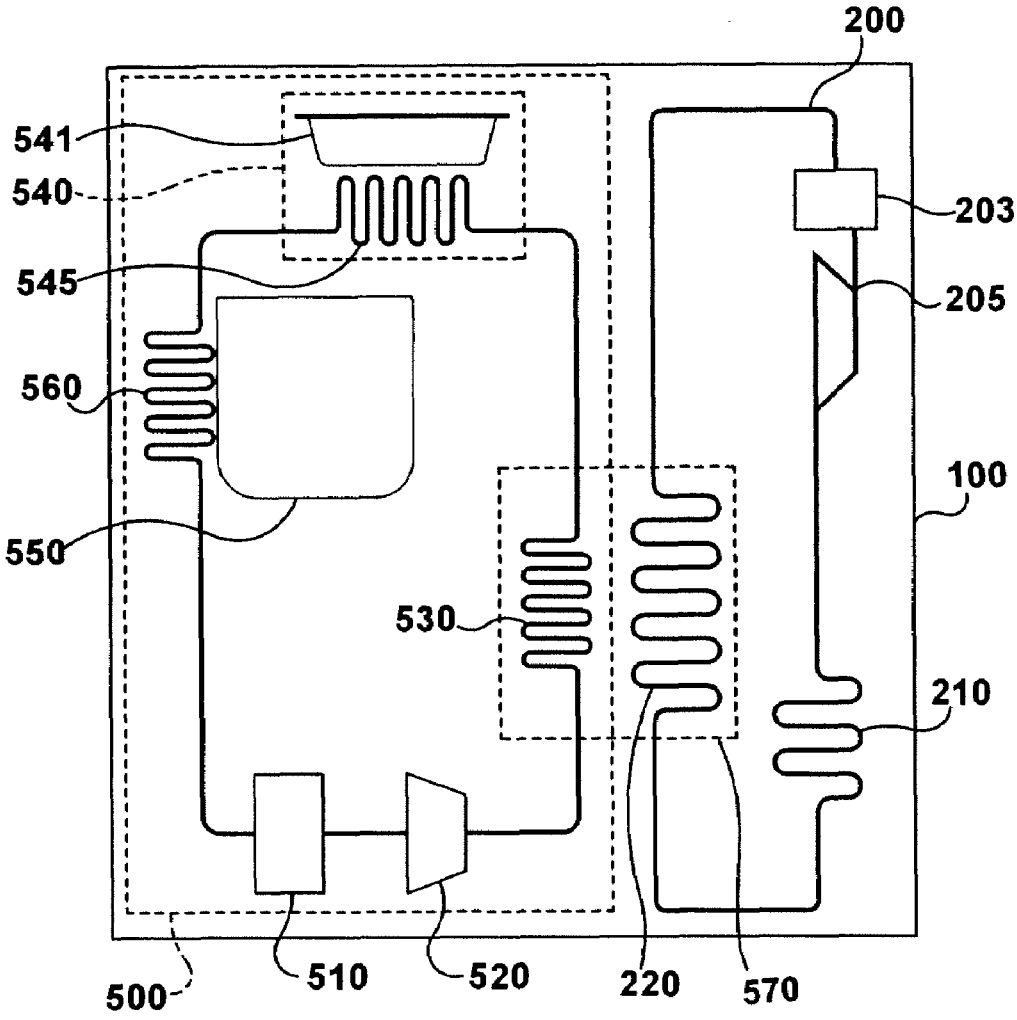
FIG. 1 is a schematic view of a refrigerator including an ice producing apparatus.
Figure 2:
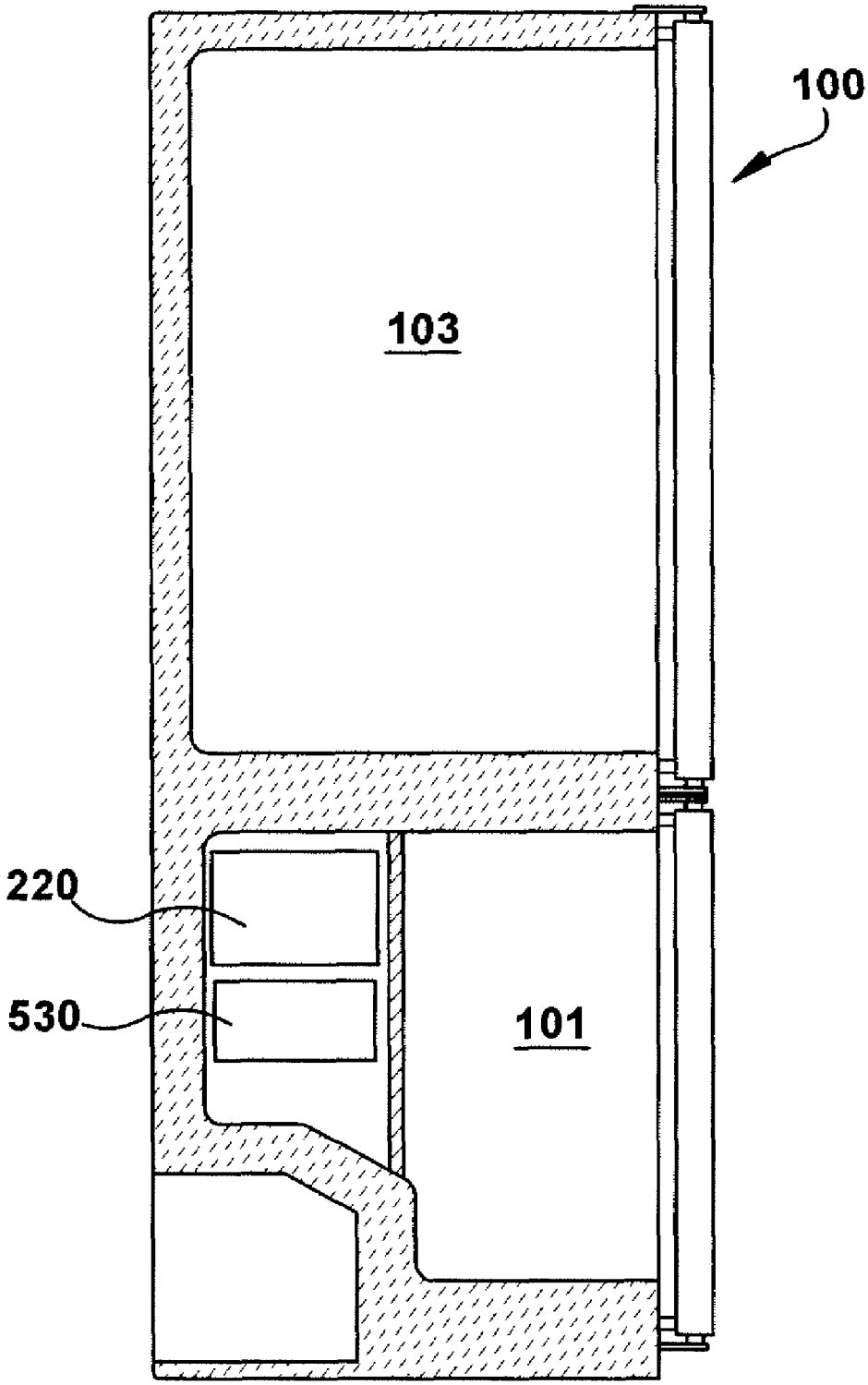
FIG. 2 is a side partial cross-sectional view of the refrigerator of FIG. 1.

FIG. 1 is a schematic view of a refrigerator including an ice producing apparatus, and FIG. 2 is a side view of the refrigerator. As shown in the figures, the refrigerator 100 includes a freezer compartment cooling system 200 and an ice producing apparatus 500.

The following explanation of the freezer compartment cooling system 200 is understood to be exemplary, as the refrigerator 100 that include the ice producing apparatus 500 can be used in conjunction with various systems that cool a freezer compartment 101 and/or a fresh food compartment 103.

In general, air in an interior of the freezer compartment 101 is made cold by the freezer compartment cooling system 200, and in particular by a freezer compartment condenser 203, a freezer compartment compressor 205 and a freezer compartment heat exchanger 210, in a known manner. The fresh food compartment 103 is cooled by controlling a flow of cool air from the freezer compartment 101 to the fresh food compartment 103. The freezer compartment 101 is cooled to a temperature equal to or less than a standard freezing point temperature of water (i.e., equal to or less than 0 degrees Celsius), being configured to store or have disposed in an interior thereof frozen foods and liquids. In contrast, the fresh food compartment 103 is cooled to a temperature above the standard freezing point temperature of water, being configured to store or have disposed in an interior thereof fresh foods and liquids. Components of the freezer compartment cooling system 200, including the freezer compartment condenser 203, the freezer compartment compressor 205 and the freezer compartment heat exchanger 210, are known to those of ordinary skill in the art, and therefore further explanation is not required to provide a complete written description of embodiments of the invention or to enable those of ordinary skill in the art to make and use embodiments of the invention, and is not provided except with reference to the ice producing apparatus 500.

The ice producing apparatus 500 can be configured to produce ice, and to provide the produced ice through an opening in a door of the fresh food compartment 103. It is contemplated that the ice producing apparatus 500 can be used with a bottom freezer refrigerator, in which the bottom freezer compartment is disposed below the top fresh food compartment. It is understood, however, that the ice producing apparatus 500 is not limited to use in the bottom freezer refrigerator. For example, the ice producing apparatus 500 can be configured to produce ice and to provide the produced ice through an opening in a door of a fresh food compartment of a side-by-side refrigerator in which the freezer compartment is disposed to the side of the fresh food compartment. Alternately, the ice producing apparatus 500 can be disposed in various refrigerators in which the fresh food and freezer compartments are disposed in a variety of positions relative to one another. It is further understood that the refrigerator in which the ice producing apparatus 500 is disposed is not required to have one or only one of each of the fresh food and freezer compartments, but rather can include none, or one or more of each of the fresh food and freezer compartments. By way of non-limiting examples, the ice producing apparatus 500 can be disposed in the refrigerator that includes one or more fresh food compartments and no freezer compartment, or that includes one or more freezer compartments and no fresh food compartment.

The ice producing apparatus 500 is provided in addition to the freezer compartment cooling system 200, and produces and provides ice separate from operation of the freezer compartment cooling system 200. By this arrangement, disadvantages associated with a known ice maker, particularly in a bottom freezer refrigerator, are overcome. Specifically, in embodiments of the invention, ice is produced at a relatively quicker rate because ice production is not dependent on a volume or temperature of cold air that can be pumped within an interior of the door of the fresh food compartment.

As shown in the figures, the ice producing apparatus 500 includes a medium storage tank 510 configured to hold a medium used to cool water to a temperature equal to or less than the standard freezing point temperature of water. The medium flows through the ice producing apparatus 500 in the following cyclical manner.

A pump 520 is configured to pump the medium from the medium storage tank 510 to a medium path 530 in a heat exchanger 570 (e.g., an evaporator). In the medium path 530, the medium is cooled through heat transfer, discussed in further detail below, to the temperature less than the standard freezing point temperature of water.

The cooled medium flow through an ice forming device 540 configured to freeze water to produce ice. In the embodiments shown in the drawings, the ice forming device 540 includes an ice mold 541. The ice mold 541 includes one or more cavities configured to receive water from an outside water source (e.g., from a water line), and to retain the water during freezing of the water, as described below.

The ice forming device 540 also includes a heat exchanger 545 disposed adjacent (e.g., near or as a portion of) the cavities of the ice mold 541. It is contemplated that in embodiments of the invention, the heat exchanger 545 is formed as one or more channels formed, cast, molded or otherwise provided in a bottom of the ice mold 541 and/or the ice forming device 540 while on a top of the ice mold 541, the top of the ice mold 541 and the ice forming device 540 being open to receive the water that is to be frozen to produce ice. By this arrangement, cooled medium flowing through the heat exchanger 545 of the ice forming device 540 absorbs heat from a volume adjacent the heat exchanger 545. As discussed above, the cooled medium cools the water retained in the cavities to the temperature equal to or less than the standard freezing point temperature of water. As a result, the water retained in the cavities of the ice mold 541 freezes, producing ice. The ice produced in the cavities of the ice mold 541 is often referred to as "ice cubes," although the ice can be of various shapes.

An ice receptacle 550 is configured to receive ice from the ice forming device 540, and to retain ice therein. Features of the ice receptacle 550 are known to those of ordinary skill in the art, and therefore further explanation is not required to provide a complete written description of embodiments of the invention or to enable those of ordinary skill in the art to make and use embodiments of the invention, and is not provided. Similarly, details of an ice delivery system configured to deliver ice from the ice forming device 540 to the ice receptacle 550, whether separate from or a component of the ice forming device 540 and/or the ice receptacle 550, are also known, and are therefore neither required nor provided. Still further, details of an ice delivery system configured to deliver ice from the ice receptacle 550 through the opening in the door of the fresh food compartment 103 are known.

In embodiments of the invention shown in the drawings, a heat exchanger 560 is disposed adjacent the ice receptacle 550, with the medium flowing through the heat exchanger 560 subsequent to flowing through the heat exchanger 545 of the ice forming device 540. Thus, the medium that has been warmed during the production of ice is further warmed, absorbing heat from a volume adjacent the ice receptacle 550. As a result, melting of ice retained within the ice receptacle 550 is impeded or prevented. In embodiments of the invention, it is contemplated that the temperature of the warmed medium flowing through the heat exchanger 560 is still less than the standard freezing point temperature of water, such that melting of ice in the ice receptacle 550 is prevented. It is to be understood, however, that the heat exchanger 560 is not required in the ice producing apparatus 500, and that in alternate embodiments the melting of ice retained within the ice receptacle 550 is impeded or prevented without the use of the heat exchanger 560. In such alternative embodiments, the ice receptacle 550 is disposed adjacent the ice forming device 540 and/or the heat exchanger 545. As a result, ice in the ice receptacle is prevented from melting as a result of cooling by the heat exchanger 545. For example, when the ice receptacle 550 is disposed below the ice forming device 540 and the heat exchanger 545, cold air flows from the heat exchanger 545 to the ice receptacle 550 as a result of natural convention.

The warmed medium flows back to the medium storage tank 510. Continued operation of the ice producing apparatus 500 is provide by repetition of the above-described flow of the medium through the medium path 530 and heat exchangers 545 and 560, among the other components of the ice producing apparatus 500.

In embodiments of the invention, the above-described medium path 540, in which the medium is cooled before subsequent ice production and cooling of the produced ice by the ice producing apparatus 500, operates in conjunction with a refrigerant coil 220 of the freezer compartment cooling system 200. Specifically, refrigerant flows through the refrigerant coil 220, while the medium flows through the medium path 530. The refrigerant in the refrigerant coil 220 absorbs heat from the medium flowing in the medium path 530, the liquid refrigerant at least partially evaporating from a liquid to a gas while flowing through the refrigerant coil 220. As a result of the refrigerant absorbing heat from the medium, the temperature of the medium is decreased, such that the medium is able to cool the water in the ice forming device 540 to the temperature equal to or less than the standard freezing point temperature of water, in the manner discussed above. By this arrangement, the refrigerant and the cooling medium are disposed in separate, adjacent paths of the evaporator of the freezer compartment cooling system 200, referred to as a heat exchanger 570.

In embodiments of the invention, the refrigerant has an evaporation temperature of less than about 0 degrees Celsius. Further, in embodiments of the invention, the medium is propylene glycol and water, commonly referred to as "anti-freeze," and is cooled to a temperature well below the standard freezing point temperature of water when flowing through the medium path 530.

In embodiments of the invention shown in the drawings, the medium path 530 and the heat exchangers 545 and 560 are disposed downstream from one another, respectively, without intervening heat exchangers disposed therebetween. It is understood, however, that this efficient arrangement is not required, and intervening heat exchangers may be included. Further, the heat exchanger 560 is not required to be disposed downstream of the heat exchanger 545, and the heat exchanger 560 can be disposed upstream of the heat exchanger 545. Similarly, the medium storage tank 510 and/or the pump 520 can be disposed at various locations within the ice producing apparatus 500, and therefore the depicted and described locations are understood not to limit the locations of these components.

Components of the ice producing apparatus 500 also can be disposed in various locations within the refrigerator 100, and are not limited to those exemplary locations depicted in the drawings. It is contemplated that in embodiments of the invention the storage tank 510, the pump 520 and/or the medium path 530 are disposed next to a back wall of the freezer compartment 101 and behind a freezer evaporator cover. The medium is cooled by the absorption of heat by the refrigerant undergoing expansion, in the manner described above. However, these components are not limited to such locations within the refrigerator 100.

This written description uses examples to disclose embodiments of the invention, including the best mode, and also to enable a person of ordinary skill in the art to make and use embodiments of the invention. It is understood that the patentable scope of embodiments of the invention is defined by the claims, and can include additional components occurring to those skilled in the art. Such other arrangements are understood to be within the scope of the claims.

The invention claimed is:

1. A refrigerator comprising:

a compartment cooling section configured to cool an interior compartment of the refrigerator, the compartment cooling section comprising a first heat exchanger configured to have a refrigerant flow therethrough to absorb heat; and an ice producing apparatus configured to produce ice and to deliver the produced ice through an opening in a door of the refrigerator, the ice producing apparatus comprising:

a storage tank configured to store a cooling medium;

a second heat exchanger disposed downstream of the storage tank and configured to have the cooling medium flow therethrough to be cooled;

an ice mold comprising at least one cavity that is configured to retain water therein; and a third heat exchanger disposed downstream of the second heat exchanger and configured to have the cooling medium flow therethrough to freeze the water in the ice mold to produce ice.

2. The refrigerator of claim 1, wherein the ice producing apparatus further comprises:

a pump configured to flow the cooling medium through the second heat exchanger and the third heat exchanger.

3. The refrigerator of claim 1, wherein the ice producing apparatus further comprises:

an ice delivery system configured to deliver ice through the opening in the door of the refrigerator.

4. The refrigerator of claim 3, wherein the ice producing apparatus further comprises:

an ice receptacle configured to receive ice from the ice mold.

5. The refrigerator of claim 4, wherein the ice delivery system is disposed in a door of the interior compartment of the refrigerator.

6. The refrigerator of claim 4, wherein the ice delivery system is disposed in a door of a fresh food compartment of the refrigerator, the fresh food compartment being configured to be cooled to a temperature above a freezing point temperature of water.

7. The refrigerator of claim 4, wherein the interior compartment comprises a fresh food compartment and a freezer compartment, the fresh food compartment being configured to be cooled by the compartment cooling system to a temperature above a freezing point temperature of water, the freezer compartment being configured to be cooled to a temperature equal to or less than the freezing point temperature of water, and the fresh food compartment being disposed at an elevation above the freezer compartment.

8. The refrigerator of claim 4, wherein the ice producing apparatus further comprises:

a pump configured to flow the cooling medium through the second and third heat exchangers.

* * * * *

UNITED STATES PATENT AND TRADEMARK OFFICE

CERTIFICATE OF CORRECTION

PATENT NO. : 7,610,773 B2
APPLICATION NO. : 11/610798
DATED : November 3, 2009
INVENTOR(S) : Rafalovich et al.

It is certified that error appears in the above-identified patent and that said Letters Patent is hereby corrected as shown below:

In Column 3, Line 49, delete "flow" and insert -- flows --, therefor.

In Column 4, Line 40, delete "alternative" and insert -- alternate --, therefor.

In Column 4, Line 50, delete "provide" and insert -- provided --, therefor.

In Column 4, Line 55, delete "540," and insert -- 530, --, therefor.

Signed and Sealed this

Ninth Day of February, 2010

David J. Kappos

David J. Kappos
*Director of the United States Patent and Trademark Office*